US011305569B2

(12) United States Patent
Seras Franzoso et al.

(10) Patent No.: US 11,305,569 B2
(45) Date of Patent: Apr. 19, 2022

(54) REGULATING DEPOSITION CHARACTERISTICS

(71) Applicant: HEWLETT-PACKARD DEVELOPMENT COMPANY, L.P., Spring, TX (US)

(72) Inventors: Mauricio Seras Franzoso, Sant Cugat del Valles (ES); Andreas Muller, Sant Cugat del Valles (ES); Antonio Gracia Verdugo, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 61 days.

(21) Appl. No.: 16/768,846

(22) PCT Filed: Dec. 14, 2017

(86) PCT No.: PCT/US2017/066399
§ 371 (c)(1),
(2) Date: Jun. 1, 2020

(87) PCT Pub. No.: WO2019/117918
PCT Pub. Date: Jun. 20, 2019

(65) Prior Publication Data

US 2020/0369060 A1 Nov. 26, 2020

(51) Int. Cl.
*B41M 5/00* (2006.01)

(52) U.S. Cl.
CPC ..... *B41M 5/0023* (2013.01)

(58) Field of Classification Search
CPC ... C09D 11/101; C09D 11/033; C09D 11/037; C09D 11/107; C09D 11/322; C09D 11/36; C09D 11/38; C09D 11/326; C09D 11/03; C09D 11/40; C09D 11/30; C09D 11/32; C09D 11/324; C09D 11/328; C09D 11/102; C09D 11/005; C09D 11/54; C09D 11/52; C09D 11/106; B41M 1/04; B41M 5/0047; B41M 5/0064; B41M 7/0081; B41M 5/0011; B41M 5/0017; B41M 5/0023; B41M 7/00; B41M 7/0072; B41M 5/52; B41M 5/5218; B41M 5/5227; A61L 2/087; A61L 2202/18; A61L 2202/23; B41J 25/001; B41J 25/34; B41J 25/003;
(Continued)

(56) References Cited

U.S. PATENT DOCUMENTS 5,583,547 A 12/1996 Gast
6,270,201 B1 * 8/2001 Kasperchik ..... B41J 2/1404 347/65
(Continued)

FOREIGN PATENT DOCUMENTS

WO WO-2016195620 A1 12/2016
WO WO-2016198929 A1 12/2016

OTHER PUBLICATIONS

Pro/Classic Series Printhead Instructions, 2003, https://www.foxjet.com/DesktopModules/Bring2mind/DMX/Download.aspx?EntryId=351&Command=Core_Download&language=en-US&PortalId=0.

*Primary Examiner* — Manish S Shah
(74) *Attorney, Agent, or Firm* — HP Inc. Patent Department

(57) ABSTRACT

A method for regulating a deposition characteristic of a rendering material in a rendering apparatus includes determining a status of material deposition structure, and adjusting a physical attribute of the material deposition structure.

19 Claims, 3 Drawing Sheets

(58) Field of Classification Search
CPC ..... B41J 2/21; B41J 25/312; B41J 2025/008; B41J 2202/21; B41J 2/17596; B41J 2/16508; B41J 2/1652; B41J 2/16538; B41J 2/175; B41J 2/17563; B41J 3/4078; B41J 11/0021; B41J 11/002; B41J 2/14201; B41J 2002/16502; B41J 29/02; B41J 2/17513; B41J 2/17509; B41J 29/13; B41J 2/17553; B41J 2/1606; B41J 2/1642; B41J 2/1609; B41J 2/1433; B41J 2/164; B41J 2/162; B41J 2/161; B41J 2/19; B41J 15/04; B41J 2/04588; B41J 2/04595; B41J 2/04586; B41J 2/14274; B41J 2/01; B41J 2/211; B41J 2/17; B41J 2/17593; B41J 2/2107; B41J 2/1755; B41J 2/2114; B41J 2/2117; B41J 2/2056; B41J 2/0057; B41J 3/60; B41J 2002/012; B41J 2/04598; B41F 23/042; B41F 23/0436
See application file for complete search history.

(56) References Cited

U.S. PATENT DOCUMENTS

| | | | | |
|---|---|---|---|---|
| 6,682,164 | B2 | 1/2004 | Vega | |
| 7,628,466 | B2 | 12/2009 | Cellura | |
| 2005/0052489 | A1 | 3/2005 | Kim | |
| 2005/0275675 | A1* | 12/2005 | Kakutani | B41J 2/205 347/15 |
| 2006/0111807 | A1 | 5/2006 | Gothait | |
| 2006/0189113 | A1* | 8/2006 | Vanheusden | C09D 11/30 438/597 |
| 2017/0120513 | A1 | 5/2017 | Brennan | |
| 2017/0189963 | A1* | 7/2017 | Buller | B29C 64/171 |
| 2017/0368755 | A1* | 12/2017 | Bader | G05B 19/4099 |

* cited by examiner

REGULATING DEPOSITION CHARACTERISTICS

BACKGROUND

A rendering apparatus, such as a 2D or 3D printer for example, can expel a rendering material, such as a print fluid or build material, from a nozzle. A nozzle can be in fluid communication with a reservoir for the rendering material, and a heater, such as a resistive element, can be used to vaporise some of the material in order to drive a portion out from the nozzle for deposition onto a substrate.

BRIEF DESCRIPTION OF THE DRAWINGS

Various features of certain examples will be apparent from the detailed description which follows, taken in conjunction with the accompanying drawings, which together illustrate, by way of example only, a number of features, wherein.

DETAILED DESCRIPTION

In the following description, for purposes of explanation, numerous specific details of certain examples are set forth. Reference in the specification to "an example" or similar language means that a particular feature, structure, or characteristic described in connection with the example is included in at least that one example, but not necessarily in other examples.

Figure 1:
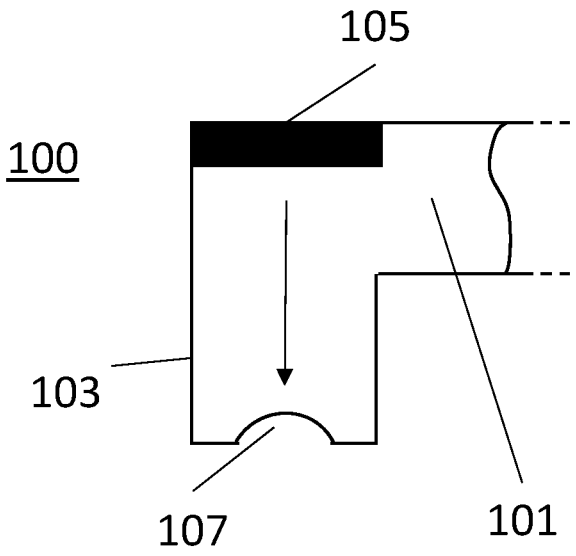
FIG. 1 is a schematic representation of a print head for a rendering apparatus according to an example.

FIG. 1 is a schematic representation of a print head for a rendering apparatus according to an example. Although the disposition of some elements of the print head 100 may vary, the basic structure comprises a reservoir or repository 101 to hold a rendering material such as a print fluid, a nozzle structure 103 through which the rendering material can be expelled for deposition to a substrate, and a heating element 105. Multiple nozzle structures 103 may be present in one print head 100, although one is shown in FIG. 1 for clarity.

The heating element 105, when energised, rapidly heats to a temperature that causes a thin layer of the rendering material near the surface of the element 105 to boil, thereby forming a vapor bubble that explosively expands. This volume expansion creates a pressure pulse in the material in the nozzle structure 103 that travels in the direction shown by the arrow, which causes some rendering material downstream of the element 105 to be ejected from opening 107. Once the heating element is de-energised, the vapor bubble that formed cools and collapses, and the surface tension of the material meniscus at opening 107 in the nozzle structure 103 pulls in more material from the reservoir 101 to refill the nozzle in preparation for the material ejection.

The rendering material in the reservoir 101 can be a print fluid that includes various components such as dyes and pigments for example. Over time, such non-volatile components can accumulate on the heating element 105 if they are not re-dissolved or re-dispersed. This can give rise to deposits that affect the efficiency of heat transfer from the element 105, which can be a thin film resistive metallic layer for example. As the ability of the element 105 may be compromised due to formation of the deposits, heat transfer to the print fluid reduces. This can result in a reduction in the weight and velocity of a drop of print fluid expelled from the nozzle structure 103 as the element 105 is energised. The effect is known as 'decel' (short for deceleration), and is generally transient in nature—that is, print fluid drops may exhibit weight and velocity reductions when the nozzle structure 103 is in operation, however the velocity and weight can return to a normal value after a period of rest, subsequently decreasing again when the nozzle structure is firing.

Thus, when the element 105 is energised and starts to fire it is clean (or substantially devoid of material deposits) and the first drops from nozzle structure 103 are at their nominal drop weight and drop velocity. However, after a number of firing events, which will depend on the print fluid in use and energy applied, a film builds up on the element which prevents effective heat transfer and therefore the generated drops get slower and smaller.

This dynamic change in drop weight and drop velocity can lead to rendering quality defects such as banding and grain. This is because drops expelled by nozzles having previously exercised (energised) heating elements 105 will have different characteristics from drops expelled by nozzles having non-previously exercised heating elements. That is, a deposition characteristic of a rendering material (such as drop velocity and/or weight) can vary between nozzles in a print head 100 as a result of heating elements 105 having been previously energized (or not).

Depending on the content of a rendered object, such as a printed image, the defect could be magnified, but will generally appear at the beginning of an area fill of a color that presents a deceleration effect because, in scanning rendering apparatuses, the nozzles that are exercised are increased in each advance of the print heads.

According to an example, there is provided a method for regulating a deposition characteristic of a rendering material in a rendering apparatus. The method determines a status of a material deposition structure, such as a nozzle structure 103 and adjusts a physical attribute of it. For example, with reference to FIG. 1, a deposition characteristic of print fluid drops expelled from nozzle structure 103 as the print head 100 is in operation will change. That is, as a result of deposits building up on the heating element 105, the drops will, over time, exhibit lower velocity and lower weight as they are expelled through the opening 107. In an example, the status of a material deposition structure (i.e. nozzle structure 103) can be determined in order to ascertain if it has been in use previously, such as having been used to expel print fluid in a rendering pass across a substrate immediately preceding a current or planned pass.

In an example, a physical attribute of the material deposition structure 103 can be a transitory film on the heating element 105. Accordingly, adjusting the physical attribute can include provoking formation of a transitory film on the heating element by, for example, using or servicing the nozzle structure, which comprises firing the nozzle structure in a service position of the print head in the rendering apparatus.

Thus, multiple nozzles of a print head of the rendering apparatus can be conditioned or primed so that they all have the same physical attribute, which means that there will be parity between the deposition characteristics of the rendering material as it is expelled from the nozzle structure. That is, if each nozzle structure of a print head is conditioned so that their respective heating elements have transitory films thereon as a result of use or servicing, then print fluid drops fired from the nozzle structures will all exhibit decel. Accordingly, the drops expelled from the nozzle structures will exhibit uniformity compared to the case in which the heating elements of some nozzle structures of a print head have a film formed thereon whilst other do not. According to an example, the heating elements of nozzle structures in a print head can therefore be conditioned to provoke formation of a film thereon.

In an example, a predetermined threshold value and the status of the material deposition structure can be used to determine whether adjustment of the physical attribute is performed. For example, historic use of a nozzle structure can be used to determine whether there is likely to be a film that has formed on a heating element. In this connection, a threshold value can be used to initiate servicing of the nozzle structure if it is determined that the level of use of the nozzle structure falls below the threshold value at which a film is likely to have formed on the heating element thereof.

Thus, data representing a prior degree of use of a nozzle structure can be used to determine whether a heating element thereof will have a physical attribute that matches the physical attribute of other nozzle structures in use. In this connection, a measure of the use of the nozzle structure for preceding rendering operations can be used to determine the status of the nozzle structure for a subsequent rendering operation. In an example, if the nozzle structure has been utilised less than the threshold value number of times in preceding rendering operations, and the nozzle structure is to be used in a subsequent rendering operation, it can be serviced so that material is deposited in a service station of the rendering apparatus which causes deposits to form on the heating element as described above. In this way, the nozzle structure in question will, in use, form print fluid drops that exhibit the same characteristics (of, for example, lower velocity and weight) as other drops expelled from other nozzle structures of the rendering apparatus that have been use in previous rendering operations to the extent that decel is present.

Figure 2:
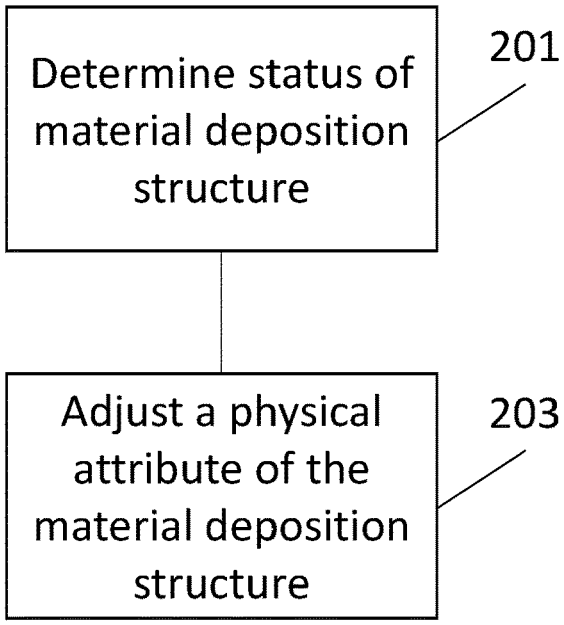
FIG. 2 is a flowchart of a method according to an example.

FIG. 2 is a flowchart of a method according to an example. In block 201 a status of a material deposition structure of a rendering apparatus is determined. For example, as described above, a measure of the use of a nozzle structure for preceding rendering operations or passes can be used to determine the status of the nozzle structure for a subsequent rendering operation. That is, given the preceding use of the nozzle structure, the status of a heating element of the nozzle structure can be determined in order to ascertain whether a film will have formed over the heating element.

In block 203, a physical attribute of the material deposition structure can be adjusted. For example, as described above, if a nozzle structure has been operated less than a threshold value number of times in preceding rendering operations, and the nozzle structure is to be used in a subsequent rendering operation, it can be serviced so that material is deposited in a service station of the rendering apparatus which causes deposits to form on the heating element as described above. In an example, the threshold value will vary based on the nozzle structure in question and the rendering material being used. For example, different structures can have different heating elements that may develop deposits of print fluid components at different rates due to differences in their heating profile, that is, the temperature reached and the rate at which it is reached. Furthermore, different rendering materials can comprise different components that may form deposits at different rates. These factors can therefore alter the number of times a nozzle structure fires (i.e. a print drop is expelled) before a film forms on the heating element. Threshold values relating to formation of films on heating elements can therefore be provided for different print heads based on data derived during manufacture for the combination of elements and rendering materials used for example.

Figure 3:
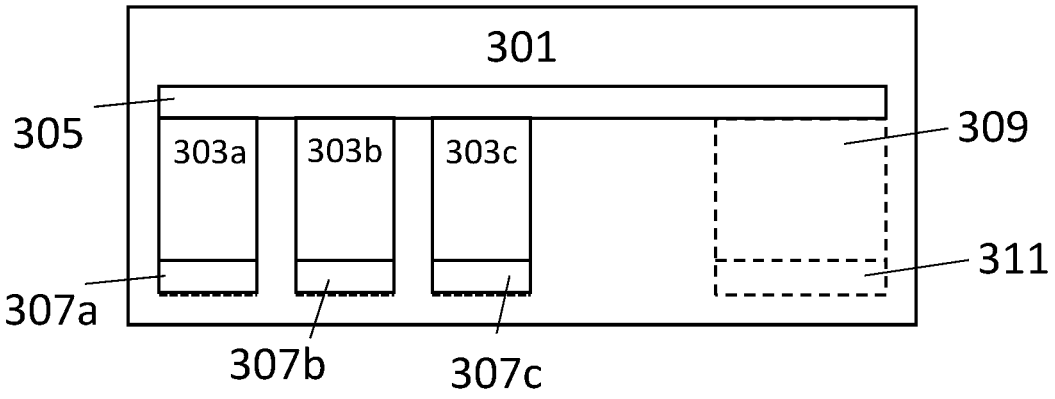
FIG. 3 is a schematic representation of a rendering apparatus according to an example.

FIG. 3 is a schematic representation of a rendering apparatus according to an example. Rendering apparatus 301 comprises multiple print heads 303*a-c* arranged on a print carriage 305. The print heads can be moved, using the carriage, relative to a substrate, onto which a rendering material can be deposited. Each print head comprises multiple nozzle structures 307*a-c*. In an example, each print head may comprise an array or matrix of nozzle structures that can be used to deposit rendering material.

Rendering apparatus 301 includes a servicing station 309. The station 309 is positioned at one side of the rendering apparatus 301. Carriage 305 can extend into the servicing station 309 to enable the print heads to be serviced. As such, there is a region 311 of the station 309 that can be used to receive print fluid drops that are expelled from the nozzle structures of the print heads. According to an example, a print head can be moved into position in station 309 in order to service one or more nozzle structures thereof in order to provoke formation of a film on a heating element. In subsequent rendering operations of the print head in question, the nozzle structures that have been primed in this way will expel print fluid drops that exhibit decel characteristics. As such, the primed nozzle structures will expel or fire print fluid drops with the same deposition characteristics as other nozzle structures of the print head or other print heads that have been in use up to that point, and whose heating elements have a film thereover as a result.

Therefore, according to an example, nozzle structures of a print head can undergo a servicing routine that is executed in view of historic data of the use of the nozzle structures in rendering operations. Thus, deceleration of print fluid drops is provoked and the drops will therefore have a stable weight and velocity (lower than the nominal one).

The number of print fluid drops fired at the beginning of a pass of a nozzle structure of a print head can be adapted taking into account the number of drops fired in a previous pass. That is, if, in the previous pass, enough drops were fired to create decel no extra drops are fired at the beginning of the new pass. Conversely, if a nozzle structure has fired less than a threshold number of drops, decel can be generated by causing the nozzle structure to fire some drops.

In an example, information from a previous pass is available thanks to drop counting that is performed for print fluid accounting and the data of the content that is going to be rendered is also available since it is used to define the number of pumps used for micro-recirculation of print fluids.

Figure 4:
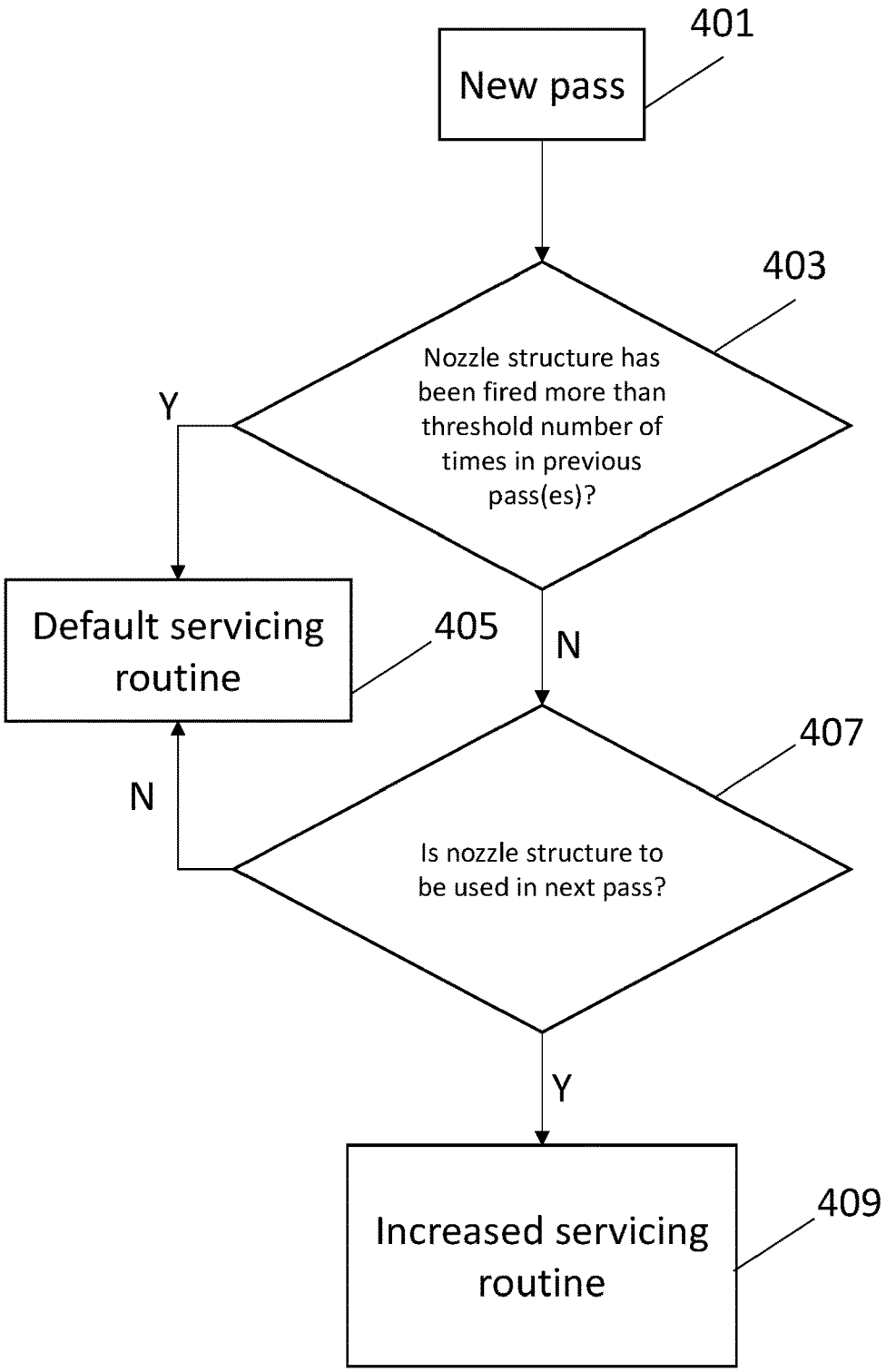
FIG. 4 is a flowchart of method according to an example.

FIG. 4 is a flowchart of method according to an example. In block 401 a new pass (rendering operation) of a print head is set to commence. In the pass, a nozzle structure of the print head will be used to deposit a rendering material to a substrate. In block 403, it is determined whether the nozzle structure has been fired more than threshold number of times in previous passes. It is has, in block 405, a default servicing routine can be applied to the nozzle structure, in which no extra firing of the nozzle structure is caused. Such default servicing can include periodically moving the print head in question to the service station (as depicted in FIG. 3 for example) to enable nozzle structures to be cleaned.

If the nozzle structure has not been fired more than threshold number of times in previous passes, in block 407 it is determined whether the nozzle structure is going to be used on the next pass of the print head. That is, it is determined whether the nozzle structure is going to be used to deposit rendering material in the next pass. If not, the default servicing routine in block 405 can be used. If it is going to be used, in block 409, an increased servicing routine can be used. As described above, the increased service routine can be used to provoke formation of a film on a heating element of the nozzle structure to generate decel in drop fired from the nozzle structure. In an example, an increased servicing routine can comprise causing the nozzle structure to fire print fluid drops in the servicing station when it otherwise would not do so, in order to cause deposits of fluid components to build up on the heating element.

Examples in the present disclosure can be provided as methods, systems or machine-readable instructions. Such machine-readable instructions may be included on a computer readable storage medium. The storage medium can include one or multiple different forms of memory including semiconductor memory devices such as dynamic or static random access memories (DRAMs or SRAMs), erasable and programmable read-only memories (EPROMs), electrically erasable and programmable read-only memories (EEPROMs) and flash memories; magnetic disks such as fixed, floppy and removable disks; other magnetic media including tape; optical media such as compact disks (CDs) or digital video disks (DVDs); or other types of storage devices.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. In some examples, some blocks of the flow diagrams may not be used and/or additional blocks may be added. It shall be understood that each flow and/or block in the flow charts and/or block diagrams, as well as combinations of the flows and/or diagrams in the flow charts and/or block diagrams can be realized by machine readable instructions.

The machine-readable instructions may, for example, be executed by a general-purpose computer, a special purpose computer, an embedded processor or processors of other programmable data processing devices to realize the functions described in the description and diagrams. In particular, a processor or processing apparatus may execute the machine-readable instructions. Thus, modules of apparatus (for example, rendering apparatus 301) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate set etc. The methods and modules may all be performed by a single processor or divided amongst several processors.

Such machine-readable instructions may also be stored in a computer readable storage that can guide the computer or other programmable data processing devices to operate in a specific mode.

For example, the instructions may be provided on a non-transitory computer readable storage medium encoded with instructions, executable by a processor.

Figure 5:
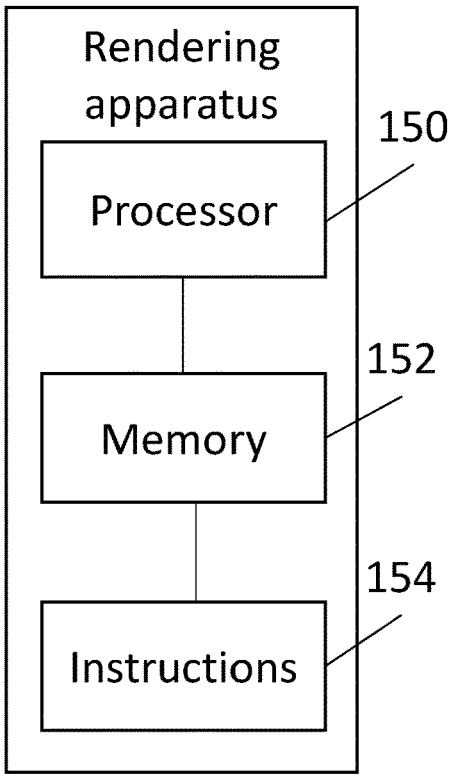
FIG. 5 shows an example of a processor of a rendering apparatus, associated with a memory according to an example.

FIG. 5 shows an example of a processor 150 of a rendering apparatus, associated with a memory 152. The memory 152 comprises computer readable instructions 154 which are executable by the processor 150. The instructions 154 comprise instructions to, at least: determine whether the nozzle structure has been fired more than a threshold number of times in previous rendering operations, determine whether the nozzle structure is to be used in a subsequent rendering operation, and execute an increased servicing routine of the nozzle structure.

Such machine-readable instructions may also be loaded onto a computer or other programmable data processing devices, so that the computer or other programmable data processing devices perform a series of operations to produce computer-implemented processing, thus the instructions executed on the computer or other programmable devices provide a operation for realizing functions specified by flow(s) in the flow charts and/or block(s) in the block diagrams.

While the method, apparatus and related aspects have been described with reference to certain examples, various modifications, changes, omissions, and substitutions can be made without departing from the spirit of the present disclosure. In particular, a feature or block from one example may be combined with or substituted by a feature/block of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method for regulating a deposition characteristic of a rendering material in a rendering apparatus, the method comprising:

determining a status of a material deposition structure within the rendering apparatus that deposits the rendering material;

adjusting a physical attribute of the material deposition structure that deposits the rendering material; and provoking formation of a transitory film on the material deposition structure by activating the material deposition structure, whereby to deposit rendering material.

2. A method as claimed in claim 1, further comprising:

using a predetermined threshold value for the physical attribute and the status of the material deposition structure, determining whether adjustment of the physical attribute is performed.

3. A method as claimed in claim 1, wherein determining a status of a material deposition structure includes using data representing a prior degree of use of the material deposition structure.

4. A method as claimed in claim 3, further comprising:

using a measure of the use of the material deposition structure for preceding rendering operations, determining the status of the material deposition structure for a subsequent rendering operation.

5. A method as claimed in claim 1, further comprising:

servicing the material deposition structure at a servicing position of the rendering apparatus according to an increased servicing routine.

6. The method of claim 1, wherein determining the status of the material deposition structure comprises determining whether a nozzle structure of the material deposition structure has been fired more than a threshold number of times, the threshold number being indicative of a transitory film having formed on a heating element of the nozzle structure.

7. The method of claim 6, further comprising, when the nozzle structure has not been fired more than the threshold number of times, servicing the nozzle structure by firing the nozzle structure an additional number of times to provoke formation of a transitory film on the heating element of the nozzle structure to adjust the physical attribute of the material deposition structure.

8. The method of claim 6, further comprising, determining that the nozzle structure has been not fired more than the threshold number of times before adjusting the physical attribute of the material deposition structure.

9. The method of claim 8, further comprising, determining that the nozzle structure has not been fired more than the threshold number of times and determining that the nozzle structure is to be used in a next pass of the material deposition structure before adjusting the physical attribute of the material deposition structure.

10. A rendering apparatus comprising a processor and a material deposition structure, the processor to:

determine a current status of a material deposition structure using data representing previous use thereof;

trigger conditioning of the material deposition structure to adjust a physical attribute thereof; and execute deposition of rendering material as a part of a service routine for the material deposition structure to provoke formation of a transitory layer over a portion of a heating element of the material deposition structure.

11. A rendering apparatus as claimed in claim 10, the processor further to:

determine whether conditioning is triggered using a predetermined threshold value for the physical attribute.

12. A rendering apparatus as claimed in claim 10, wherein the heating element is a resistive element.

13. A rendering apparatus as claimed in claim 10, further comprising a servicing station to service a material deposition structure of a print head.

14. A rendering apparatus as claimed in claim 10, further comprising a memory to store data representing information from a previous pass of the material deposition structure.

15. The rendering apparatus of claim 10, wherein the rendering apparatus comprises a 3D printer.

16. The rendering apparatus of claim 10, wherein the rendering apparatus comprises a printer, the material deposition structure to deposit printing fluid under control of the processor.

17. The rendering apparatus of claim 10, further comprising a service station positioned at one side of the rendering apparatus where the service routine is performed by the processor on the material deposition structure.

18. A non-transitory machine-readable storage medium encoded with instructions executable by a processor of a rendering apparatus for provoking formation of a transitory film on a heating element of a nozzle structure in a print head of the rendering apparatus, the machine-readable storage medium comprising instructions to:

determine whether the nozzle structure has been fired more than a threshold number of times in previous rendering operations;

determine whether the nozzle structure is to be used in a subsequent rendering operation;

execute an increased servicing routine of the nozzle structure; and activate the nozzle structure in the servicing station whereby to provoke formation of the transitory film on the heating element.

19. A non-transitory machine-readable storage medium as claimed in claim 18, further comprising instructions to:

use a predetermined threshold value for a physical attribute and a status of the nozzle structure to determine whether the increased servicing routine of the nozzle structure is performed.

* * * * *